United States Patent [19]

Meyer

[11] Patent Number: 4,628,974

[45] Date of Patent: Dec. 16, 1986

[54] APPARATUS FOR AUTOMATED ASSEMBLY OF FLOWABLE MATERIALS

[76] Inventor: Ronald K. Meyer, 617 7th St., San Francisco, Calif. 94103

[21] Appl. No.: 589,542

[22] Filed: Mar. 14, 1984

[51] Int. Cl.[4] ..... B67D 1/00; B67D 5/56; B65B 3/06

[52] U.S. Cl. ..... 141/129; 141/103; 141/104; 141/168; 141/271; 222/129.4; 901/17; 364/479

[58] Field of Search ..... 141/1, 98, 91, 92, 129, 141/103, 104, 135-138, 153, 168, 171-174, 234, 250, 266, 271, 275, 392; 222/2, 144, 129, 129.1, 129.2, 129.3, 129.4, 144.5; 901/17, 18; 414/744 R; 364/478, 479

[56] References Cited

U.S. PATENT DOCUMENTS

| | | | |
|---|---|---|---|
| 2,814,317 | 11/1957 | Gale | 141/103 |
| 2,852,043 | 9/1958 | Cooper | 141/104 |
| 3,095,982 | 7/1967 | Weiser | 901/17 X |
| 3,409,176 | 11/1968 | Krouse | 222/640 |
| 3,428,218 | 2/1969 | Coja | 222/129.4 |
| 3,629,858 | 12/1971 | Hayakawa et al. | 222/2 X |
| 3,685,692 | 8/1972 | Erne et al. | 222/129.4 X |
| 3,822,729 | 7/1974 | Rochette | 141/98 |
| 3,827,467 | 8/1974 | Henley et al. | 141/250 |
| 3,915,207 | 10/1975 | Greenfield, Jr. et al. | 141/104 |
| 3,940,019 | 2/1976 | Kross et al. | 222/129.4 X |
| 4,162,028 | 7/1979 | Reichenberger | 222/129.4 |
| 4,169,521 | 10/1979 | Vayda, Jr. | 141/98 |
| 4,252,253 | 2/1981 | Shannon | 222/129.4 X |
| 4,348,142 | 9/1982 | Figour | 901/17 X |

FOREIGN PATENT DOCUMENTS

| | | | |
|---|---|---|---|
| 1067461 | 12/1979 | Canada | 141/1 |
| 1371685 | 7/1964 | France | 401/18 X |

*Primary Examiner*—Stephen Marcus
*Assistant Examiner*—Ernest G. Cusick
*Attorney, Agent, or Firm*—Thomas M. Freiburger

[57] ABSTRACT

Apparatus for the automated assembly of flowable materials into a receptacle for delivery to a selected location is disclosed. The apparatus includes a plurality of spaced flowable material dispensing means, a plurality of spaced receptacle storage means and a plurality of spaced receptacle delivery locations. A robot arm is provided to receive, support and transport the receptacles. The apparatus includes a computer adapted to cause the robot arm to select a receptacle at one of the receptacle storage means, transport it to more than one of the flowable material dispensing means in a predetermined sequence and deliver the receptacle with the assembly of flowable materials therein to a predetermined one of the receptacle delivery locations in response to a given computer command signal. Structural details of the robot arm and an embodiment of the apparatus specifically adapted to provide an automated bartender function are described.

17 Claims, 18 Drawing Figures

APPARATUS FOR AUTOMATED ASSEMBLY OF FLOWABLE MATERIALS

FIELD OF THE INVENTION

This invention relates to apparatus for assembling flowable materials into a receptacle and more particularly to a self-contained unit providing fully automated assembly of a variety of flowable materials in a variety of receptacles for delivery to a variety of locations on command.

BACKGROUND OF THE INVENTION

The prior art is full of devices directed to solving the problem of automatically dispensing mixed drinks or other liquid combinations. The effort to mechanize the bartender has engaged inventors for a long time, as may be seen for example in such U.S. Pat. Nos. 902,203; 3,067,912; 3,119,488; 3,193,143; 3,341,078; 3,409,176; 3,428,218; 3,675,820; 3,827,467; 3,830,405; and 3,949,902.

However, the basic approach in the prior art has always been to assemble the liquids or other flowable materials into the receptacle at a given location which is also the location at which the receptacle containing the mixed drink, beverage or other liquid and flowable material combination is delivered. Thus, in the prior art, means were provided for conducting all of the necessary liquids or other ingredients for a given drink, for example, to a given location and means were provided for positioning a receptacle at such location to receive the mixture of such liquids or other ingredients without movement of the receptacle. Finally, in the prior art, the receptacle containing the mixture of liquids and other ingredients was received by the user at the given location without movement of the filled receptacle other than by the user.

The approach taken in the prior art has tended to limit the number of different flowable ingredients that can be assembled into a given receptacle since all of such ingredients are dispensed into the receptacle at a given location. The approach taken in the prior art has also tended to multiply the space requirements by the number of different mixtures of flowable materials desired, since redundant apparatus is required if more than one dispensing location is provided. Finally, the approach taken in the prior art has tended to require that each assembly of flowable materials in a given receptacle be completed and the receptacle removed by the user before another assembly in a further receptacle can be initiated.

A primary object of this invention is to overcome the above limitations of the prior art.

SUMMARY OF THE INVENTION

Apparatus for the automatic assembly of flowable materials into a receptacle and delivery to a selected location according to this invention comprises an elongated arm with a receptacle receiving and support means mounted on one end of the arm for rotation about a first axis substantially normal to the axis of elongation of the arm. The other end of the arm is mounted on a shoulder means for rotation about a second axis substantially parallel to the first axis. The shoulder means is mounted on a carrier means for selective rectilinear movement in a given plane substantially parallel to the first and second axes. The carrier means is mounted on a support means for selective rectilinear movement normal to the selective rectilinear movement of the shoulder means. A first drive means is provided for selectively rotating the receptacle receiving and support means about the first axis and a second drive means is provided for selectively rotating the elongated arm about the second axis. A third drive means is provided for selectively moving the shoulder means on the carrier means and a fourth drive means is provided for selectively moving the carrier means on the support means. A control means is provided for the integrated control of the first, second, third and fourth drive means in response to a given command whereby the receptacle receiving and support means can be positioned at any point in a volume of rectangular cross-section intersected by said given plane.

BRIEF DESCRIPTION OF THE DRAWING

This invention will be more fully understood from a reading of the following detailed description of a preferred embodiment thereof in conjunction with the appended drawing wherein.

DETAILED DESCRIPTION

Figure 1:
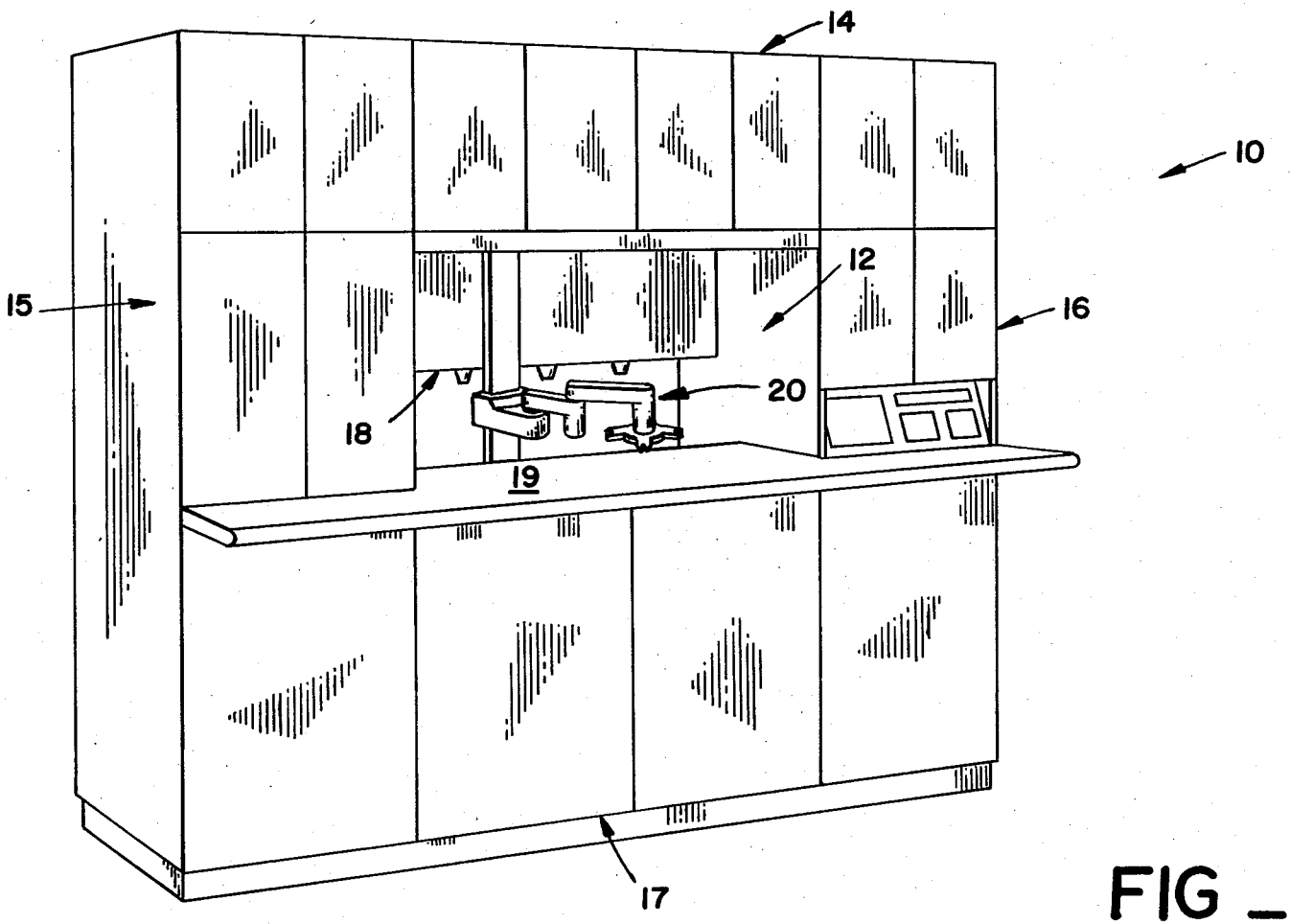
FIG. 1 is a perspective view of an embodiment of this invention specifically adapted to function as an automated bartender.

An embodiment 10 of applicant's invention as specifically adapted to provide automated bartender services is shown in the drawing and will be described in detail hereinafter. The embodiment 10 illustrates the novel features of applicant's invention and it should be understood that such novel features can be adapted for other purposes.

Thus referring to FIG. 1 of the drawing, it will be seen that applicant's apparatus comprises a hollow central dispensing and delivery cubicle 12. The cubicle 12 may be surrounded by storage and/or delivery structure. According to the embodiment 10 as shown in FIG. 1, storage structure is provided along the top 14 and sides 15 and 16 of the cubicle 12. In addition, storage structure 17 is provided at the bottom of the front of the cubicle 12 and a dispensing structure 18 is provided along the top portion of the back of the cubicle 12. A delivery structure in the form of a counter top or bar 19 is provided along the front of the cubicle 12 above the storage structure 17 leaving the remainder of the front of the cubicle 12 open.

According to this invention, a robot arm structure 20 is mounted for movement within the cubicle 12 as will be more fully described hereinafter. It is noted that the robot arm structure 20 according to this invention is specifically adapted to assemble flowable materials into a receptacle. To this end the robot arm structure 20 must be capable of moving to any point in a substantially vertical planar surface of given height and width and in addition, must be capable of projecting transversely from said planar surface at any such point.

Referring to FIGS. 2 through 5, it will be seen that the embodiment 10 of this invention for providing automated bartender services is specifically designed as a wall unit. To this end, such unit 10 has a dimension from the top 14 to the bottom 17 of about eight feet and a dimension from one side 15 to the other side 16 of about ten feet. The unit 10 has a depth of about two and one-half feet and the back 21 of the unit 10 defines a planar surface adapted to fit against the wall of a room.

Figures 2, 3, 4, 5:
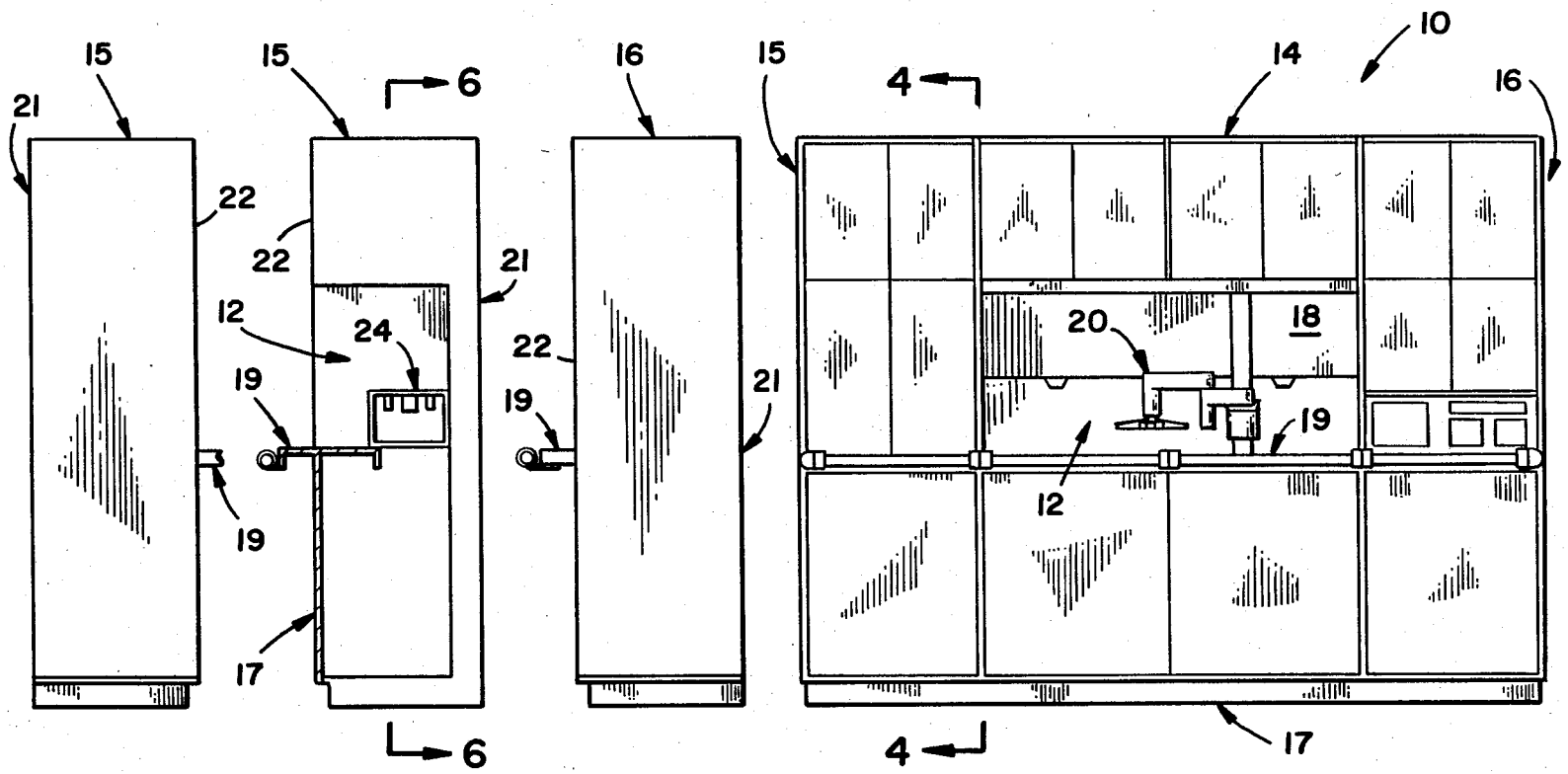
FIG. 2 is a front view in elevation of the embodiment of FIG. 1.
FIG. 3 is a right end view of FIG. 2.
FIG. 4 is a cross-sectional view taken along lines 4—4 of FIG. 2.
FIG. 5 is a left end view of FIG. 2.

The support structure along the top 14 of the unit 10 may comprise conventional cabinetry having doors opening to the front 22 of the unit 10. The support structure along the left side 15 of the unit 10 as shown in FIG. 2 may comprise an insulated refrigeration compartment having doors opening to the front 22 of the unit 10. The support structure along the right side 16 of the unit 10 as shown in FIG. 2 may be designed to house control and power supply equipment in conventional cabinetry which may include doors opening to the front 22 of the unit 10 as necessary and desirable.

As best shown in FIG. 4, the support structure along the front portion of the bottom of the hollow cubicle 12 opens into the cubicle and may be provided with conventional cabinet doors opening to the front 22 of the unit 10. In addition, as shown in FIG. 4, the refrigeration structure at the left side 15 of the unit 10 may provide a dispensing structure 24 for flowable materials accessible from the cubicle 12.

Figure 6:
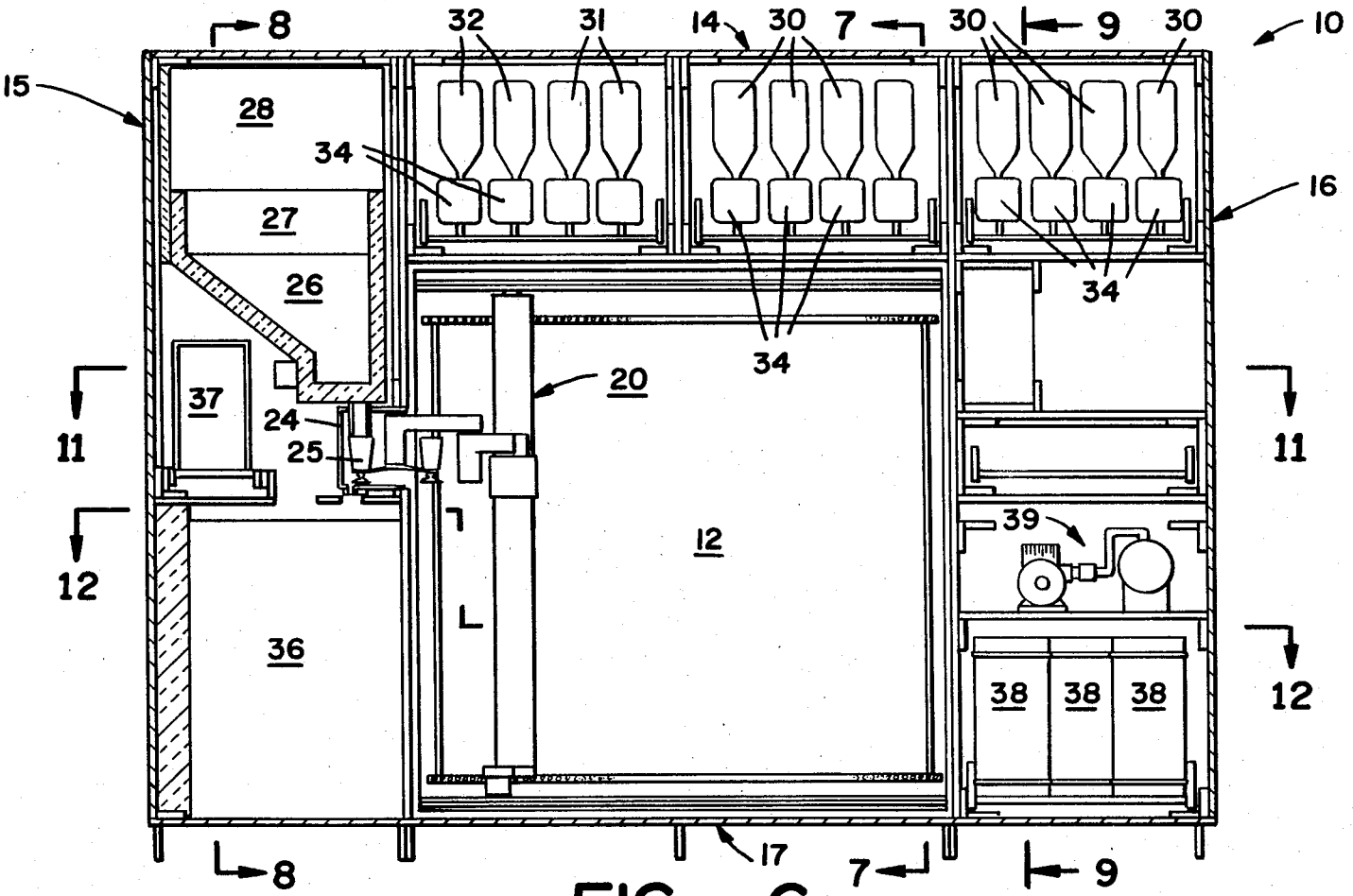
FIG. 6 is a cross-sectional view taken along line 6—6 of FIG. 4.

Referring to FIG. 6, a cross-sectional view of the unit 10 taken along line 6—6 of FIG. 4 is shown with the dispensing structure 18 and other structure at the back of the cubicle 12 omitted for simplification. The robot arm structure 20 is shown in position to support a receptacle 25 in operative relation to the dispensing structure 24 at the left of the cubicle 12.

As shown in FIG. 6, the dispensing structure 24 is coupled to the hopper 26 of an automatic ice-making machine 27 through an appropriate metering device (not shown in FIG. 6). The ice-making machine 27 may be of any type well-known in the art capable of producing crushed ice or ice cubes. According to the teaching of this invention, crushed ice is a flowable material when maintained at a suitable low temperature by the refrigeration unit 28 so that the ice particles will not stick to each other. Thus it will be understood that the flowable materials to be assembled by apparatus according to the teaching of this invention include particulate matter as well as liquids of various viscosities.

As shown in FIG. 6, a plurality of bottles of liquors and spirits 30, mixes 31 and juices 32 may be contained in the cabinetry at top 14 of the cubicle 12 and in the top of the cabinetry at the right side 16 of the cubicle 12. Each bottle 30, 31 and 32 is supported in inverted position in a commercially available electrically monitored well device 34 thus providing reservoirs of the various liquors, spirits, mixes and juices, as required. The devices 34 are connected by appropriate tubing and metering valves to the dispensing structure 18 (not shown in FIG. 6). Thus, the liquors, spirits, mixes and juices may be delivered by gravity flow to the dispensing structure 18.

In addition, a keg of beer 36, for example, may be contained in the bottom portion of the refrigeration unit at the left side 15 of the cubicle 12. Similarly, an appropriate container of white wine 37 may be contained in the refrigeration unit at the left side 15 of the cubicle 12. Thus the beer 36 and white wine 37 will be maintained in a chilled condition for delivery to the dispensing means 24 through appropriate metering devices not shown in FIG. 6. The delivery of the beer 36 may be assisted by pressurizing the container therefor as is well known in the art. Similarly, appropriate containers of red wine 38 may be mounted in the bottom of the cabinetry at the right side 16 of the cubicle 12 together with an optional air compresser 39. The red wine is conducted to the dispensing unit 18 through an appropriate pump tubing and metering device (not shown in FIG. 6).

Figure 7:
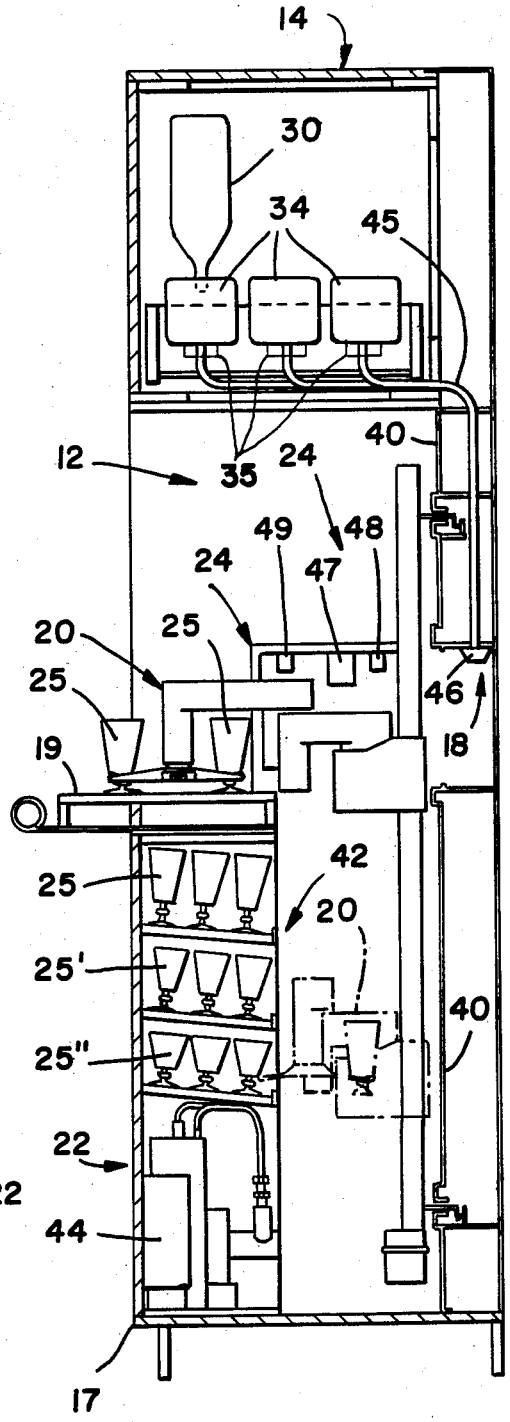
FIG. 7 is a cross-sectional view taken along line 7—7 of FIG. 6.

Referring to FIG. 7, a cross-sectional view taken along line 7—7 of FIG. 6 is shown, including a showing of the dispensing structure 18 and support structure 40 for the robot arm 20. A support structure 42 at the front of the bottom portion of the cubicle 12 containing a supply of receptacles of various sizes 25, 25', 25" into which the flowable materials are to be assembled, is also shown in FIG. 7. It will be noted that all of the receptacles 25, 25' and 25", regardless of size, have identical stem structures of reduced circumferential dimensions adapted to be received and supported on the robot arm as will be more fully described hereinafter. Thus the support structure 42 for the receptacles 25, 25' and 25" include inclined shelves adapted to feed the receptacles inwardly of the cubicle 12 by gravity. To this end, the shelves of the support structure 42 are provided with an appropriate surface to facilitate the sliding movement of the receptacles 25. 25' and 25" along the inclined shelves. Such surface may be a ridged or apertured surface of self-lubricating plastic, for example.

Also shown in FIG. 7 beneath the structure 42 at the bottom of the front portion of the cubicle 12 is a commercially available carbonator device 44 adapted to produce carbonated water by mixing the water with carbon dioxide gas, for example. The carbonated water is conducted through appropriate tubing and a metering device, not shown in FIG. 7, to the dispensing structure 18.

A plurality of well devices 34 are shown mounted within the cabinetry at the top 14 of the unit in FIG. 7. A bottle of liquor or spirits 30 is shown as mounted in one of the well devices 34. Each of the well devices 34 is connected through appropriate tubing 45 and relay valve 35 to an appropriate multiorifice nozzle 46 which is part of the dispensing structure 18. Suitable well devices 34, relay valves and nozzles are commercially available from Electronics Dispensing International (EDI) of Reno Nevada, for example. Also shown in FIG. 7 are appropriate commercially available nozzles for the dispensing of ice 47, wine 48 and beer 49 which are part of the dispensing structure 24.

In FIG. 7, the robot arm 20 is shown in position to deliver a receptacle 25 onto the counter top or bar 19. It will be seen that two receptacles 25 are carried by the robot arm 20 but only one of the receptacles will be deposited on the counter top or bar 19 at a time due to the motion of the robot arm, as will be more fully described hereinafter. The robot arm 20 is also shown in phantom in FIG. 7 in position to pick up a receptacle 25''. Also shown in phantom is a receptacle 25 which has been previously picked up by the robot arm 20, as will be more fully described hereinafter.

Figure 8:
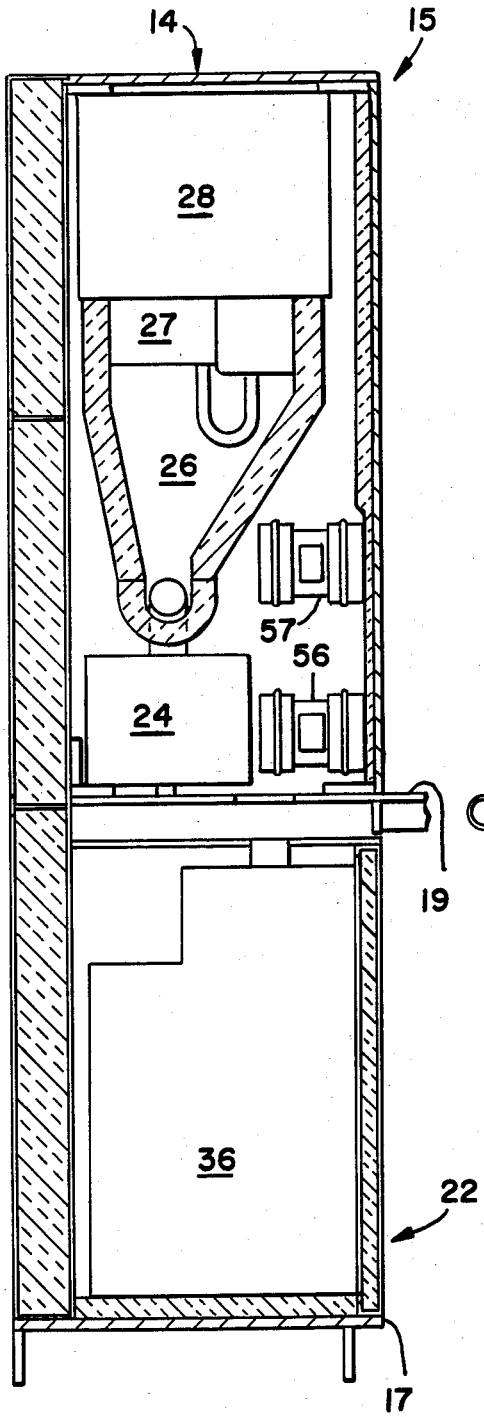
FIG. 8 is a cross-sectional view taken along line 8—8 of FIG. 6.

Referring to FIG. 8, a cross-section taken along line 8—8 of the cabinetry 18 at the left side of the cubicle 12 of FIG. 6 is shown. In FIG. 8, a commercially available electrically controlled metering device 56 for the beer 36 and a commercially available electrical metering pump 57 for the white wine 37 are represented generally. The metering devices 56 and 57 together with appropriate tubing (not shown in FIG. 8) for conducting the beer and wine therethrough to the nozzles 48 and 49, respectively, are contained within the refrigerated compartment. Thus the tubing and metering devices 56 and 57 will be chilled and the beer and wine will be delivered to a receptacle without previously encountering any unchilled surfaces.

Figure 9:
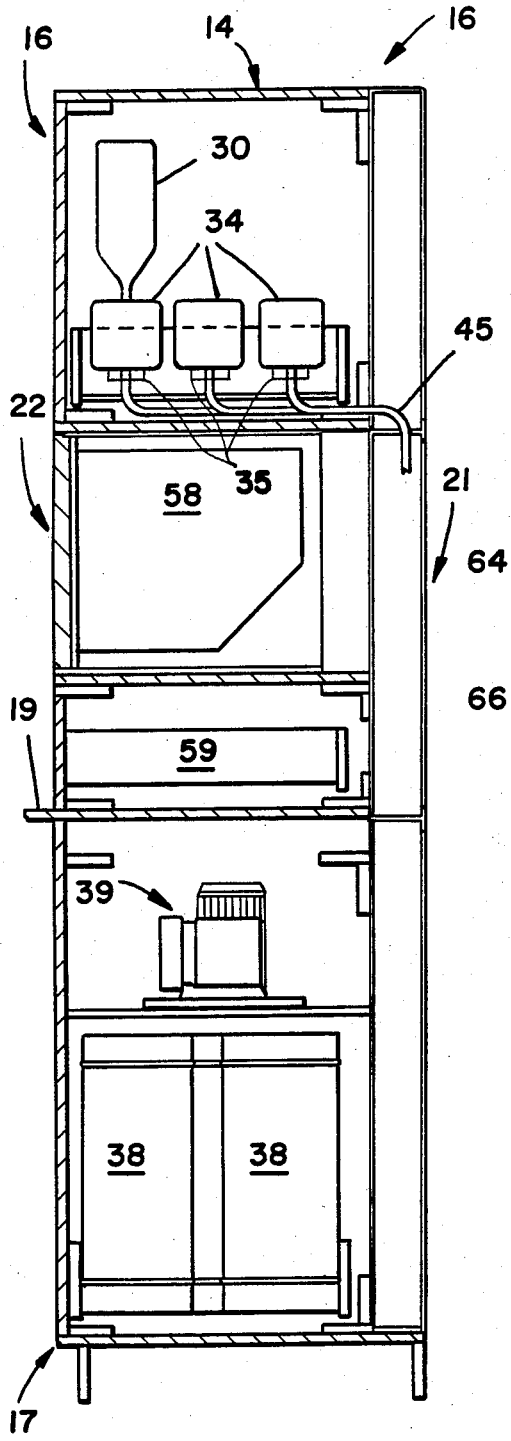
FIG. 9 is a cross-sectional view taken along line 9—9 of FIG. 6.

Referring to FIG. 9, a cross-sectional view taken along line 9—9 of FIG. 6 is shown. The compartments 58 and 59 for the power supply and control devices of the unit are represented at 58 and 59. Such power supply and control devices will be more fully discussed hereinafter. It should be noted that the structure at the back 21 of the cabinetry of the unit 10 although hollow to accommodate the tubing 45 and relay valve 35 from the well devices 34 for the liquor and spirits 30, for example, is nevertheless specifically designed for rigidity. It will be understood that the support structure 40 for the robot arm 20 is mounted on and forms a part of the structure at the back 21 of the unit and mechanical stability is an essential feature of such structure.

Figure 10:
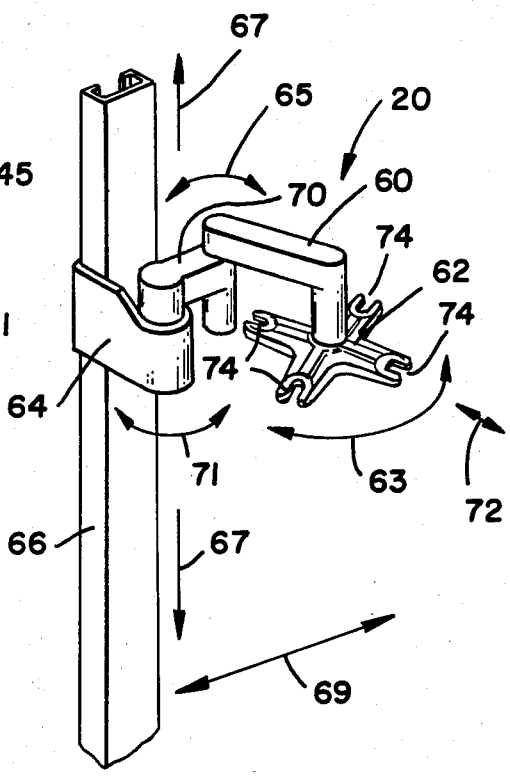
FIG. 10 is an enlarged fragmentary perspective view showing the robotic arm structure according to this invention.

FIG. 10 is an enlarged fragmentary perspective view of the robot arm structure 20 according to this invention. The various required movements of the robot arm structure 20 according to this invention are indicated by the double headed arrows in FIG. 10. Thus the robot arm structure 20 comprises an elongated substantially rectilinear arm 60. A receptacle receiving and support means 62 is mounted on one end of the arm 60 for rotation about an axis extending transversely of the arm 60 as indicated by the double headed arrow 63. The other end of the arm 60 is mounted on a shoulder means 64 for rotation about an axis extending substantially parallel to the axis of rotation of the receptacle receiving and support means 62 as indicated by the double headed arrow 65. The shoulder means 64 is mounted on a carrier means 66 for rectilinear movement in either direction therealong in a plane substantially parallel to the above-mentioned axes of rotation as indicated by the arrows 67. The carrier means 66 is mounted on the robot arm support structure 40 for rectilinear movement normal to the rectilinear movement of the shoulder means 64 on the carrier means 66 in either direction as indicated by the double headed arrow 69.

According to a preferred embodiment of this invention, a second substantially rectilinear arm 70 is interposed between the shoulder means 64 and the arm 60. Thus the arm 60 is mounted on one end of the second arm 70 for rotation as described hereinabove and indicated by the double headed arrow 65. The other end of the second arm 70 is mounted on the shoulder means 64 for rotation about an axis extending substantially parallel to the axes of rotation described hereinabove as indicated by the double headed arrow 71. Thus, simultaneous rotation as indicated by the double headed arrows 65 and 71 will produce a resultant rectilinear movement causing the receptacle receiving and support means 62 to project from or retract toward the carrier means 66, as indicated by the double headed phantom arrow 72. Such resultant rectilinear movement will provide additional flexibility in the control of the robot arm structure 20.

According to this invention, the receptacle receiving and support means 62 comprises a bifurcated member 74 dimensioned to receive the portion of reduced circumferential dimensions of the stem of the receptacles 25, 25', 25'' as described hereinabove. In the embodiment of this invention shown in the drawing, the receptacle receiving and support means 62 comprises four bifurcated members 74 defining ninety degree angles therebetween. More than four equally spaced bifurcated members 74 could be used in other embodiments of this invention. However, four is the maximum number of bifurcated members 74 which can be used in the embodiment of this invention shown in the drawing, although a single bifurcated member as well as two or three symmetrically spaced bifurcated members 74 could be used.

Figure 11:
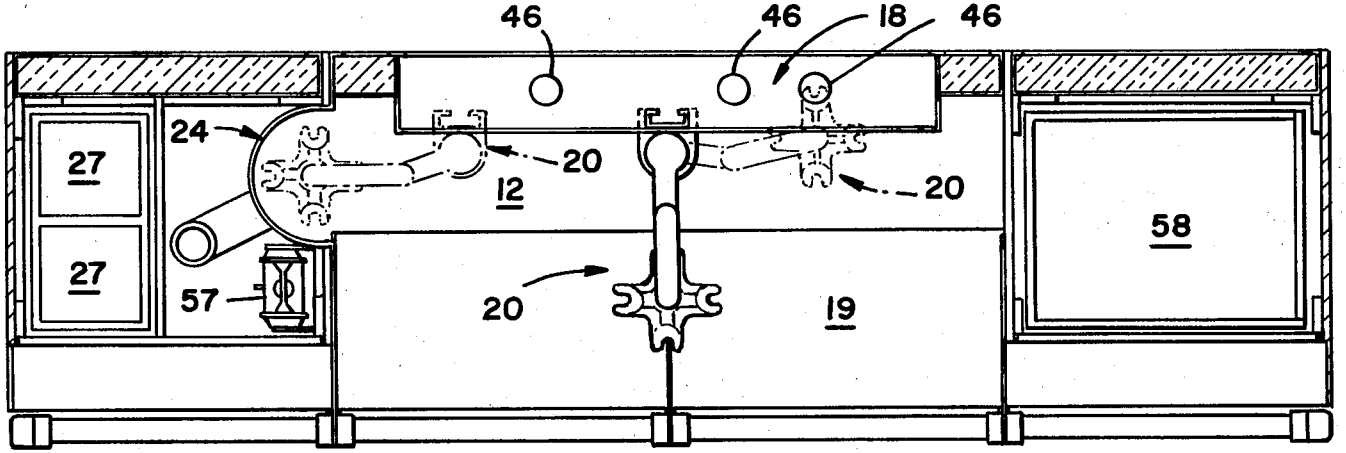
FIG. 11 is a cross-sectional view taken along line 11—11 of FIG. 6.
Figure 12:
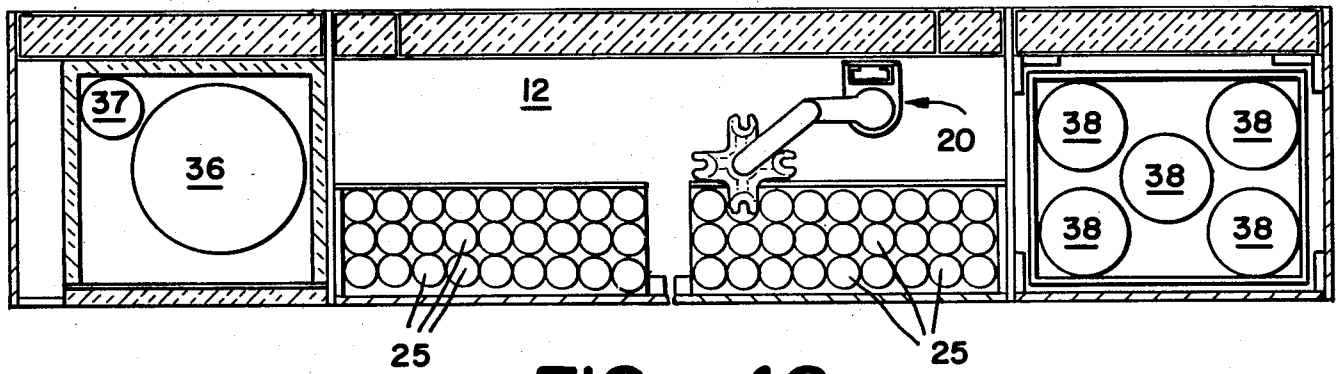
FIG. 12 is a cross-sectional view taken along line 12—12 of FIG. 6.

FIGS. 11 and 12 are cross-sectional views taken along lines 11—11 and 12—12 of FIG. 6, respectively, to illustrate the various movements of the robot arm 20 according to the teaching of this invention. Thus, in FIG. 11, the robot arm structure 20 is shown in full centrally located in the cubicle 12 and fully extended over the counter top or bar 19. The robot arm structure 20 is shown in phantom as rotated to the right to bring a receptacle received and supported thereby under the nozzle 46 of the dispensing structure 18. Similarly, the robot arm structure 20 is shown in phantom at the left of FIG. 11 as moved within the cubicle 12 and rotated to bring a receptacle into operative relation with the dispensing means 24 to receive crushed ice, beer or white wine therein.

In FIG. 12, the robot arm structure 20 is shown in full as moved to the right in the cubicle 12, lowered below the counter top or bar 19 and rotated into engagement with a receptacle 25 of the inventory of receptacles contained in the structure below the counter top or bar 19. Thus in operation, according to this invention, the robot arm structure 20 would be lowered and rotated to the position shown in FIG. 12 in order to engage and remove the receptacle 25 from the inventory of receptacles. The robot arm structure 20 would then be rotated within the cubicle 12 so that it could be raised above the counter top or bar 19 and subsequently brought into operative relation with the dispensing means 24 to receive ice into the receptacle. The robot arm structure 20 would then be moved to the right and rotated to bring the receptacle containing the ice into operative relation with the nozzle 46 of the dispensing means 18 to receive the desired liquor or spirits. Subsequent rotation and movement of the robot arm structure 20 would bring the receptacle received thereon into operative relation with any other nozzle 46 of the dispensing structure 18. When the desired assembly of flowable materials has been received in the receptacle, the robot arm structure 20 would be moved and rotated to the position shown in full in FIG. 11 with the receptacle received thereon positioned over the counter top or bar 19. In this position the robot arm structure 20 would be lowered to bring the stem of the receptacle into contact with the counter top or bar 19. The robot arm structure 20 would then be retracted to remove the receptacle from engagement therewith leaving it standing alone on the counter top or bar 19 with the desired assembly of flowable materials therein.

It will be understood that the apparatus would be programmed to enable the robot arm structure 20 to conduct a receptacle received thereon to the various dispensing nozzles in the appropriate order to receive the desired assemblage of flowable materials. As will be explained more fully hereinafter, the control means will be programmed to integrate the movements of the robot arm structure 20 with respect to each other and the metering of the flowable materials to the respective nozzles to enable the selection of any desired receptacle and any desired assemblage of flowable materials available from the inventories thereof.

It is noted that the robot arm structure 20 is capable of receiving four receptacles simultaneously thereon so that the assemblage of flowable materials into the four receptacles may be efficiently integrated for economy of movement of the robot arm 20. As best shown in FIG. 11, the receptacles may be individually positioned on the counter top or bar 19 by appropriate movement and rotation of the robot arm to allow each receptacle in turn to be released from the bifurcated receptacle receiving and support means of the robot arm structure 20.

From the above it will be understood that the robot arm structure 20 according to this invention moves the receptacle to various points for the assemblage of the flowable materials therein and thereafter moves the filled receptacle to a desired location for delivery. Thus the number of different flowable assemblages that can be made with minimum duplication of facilities is increased over the teaching of the prior art. In addition, the number of different assemblages of flowable material into receptacles which can be completed and delivered for subsequent removal by the user without interfering with the further operation of the apparatus is increased over the teaching of the prior art. In this regard, it is emphasized that the embodiment of this invention as shown in the drawing and specifically described herein is a greatly simplified embodiment of the invention. The number of delivery points could be multiplied by adding additional counter tops or bars in spaced stacked relation and the number of points at which flowable material is dispensed could also be multiplied to the extent permitted by the size of the receptacles into which the flowable materials are assembled.

Figure 13:
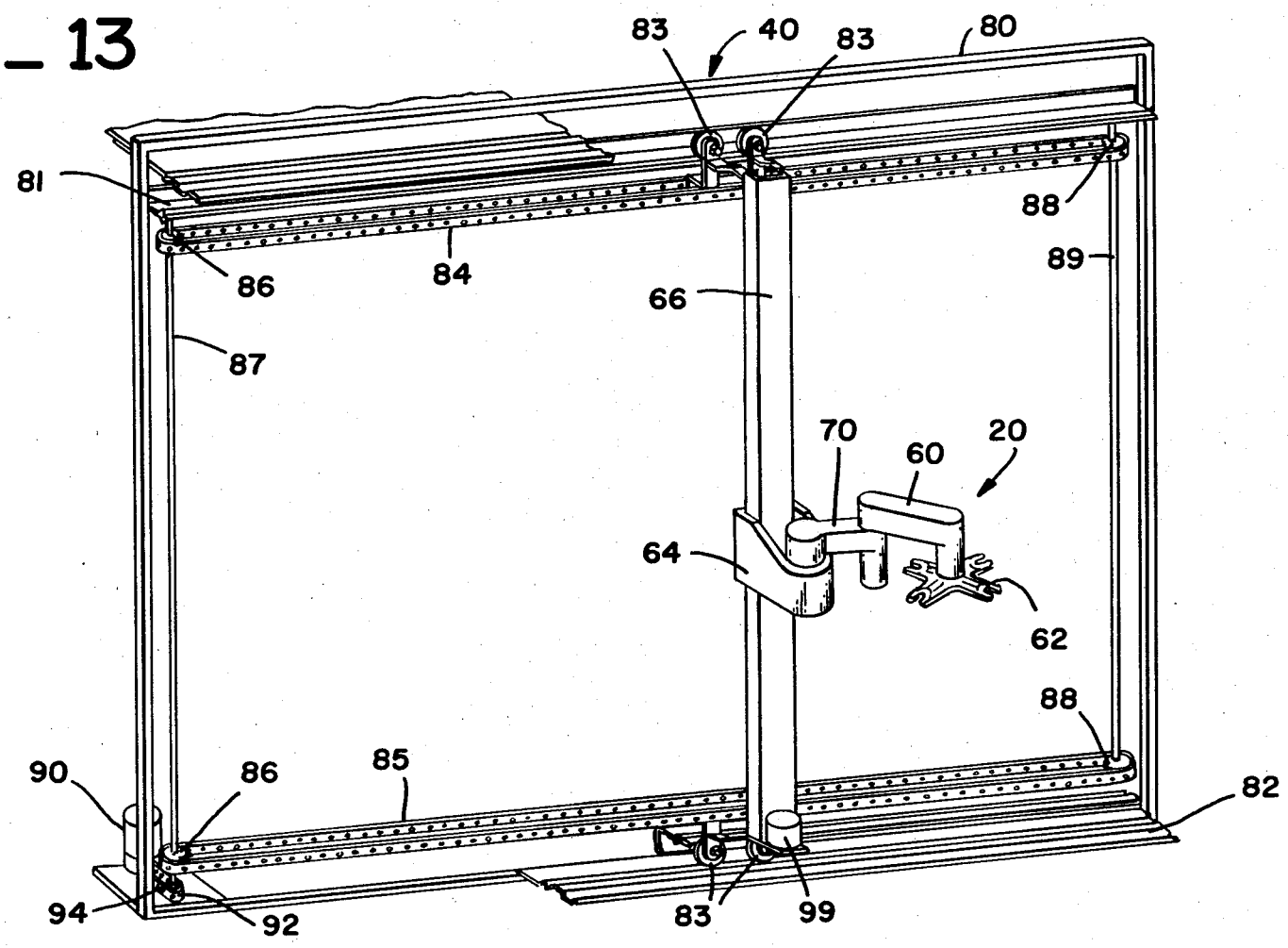
FIG. 13 is an enlarged fragmentary perspective view showing the support means for the robotic arm structure of FIG. 10.
Figure 14:
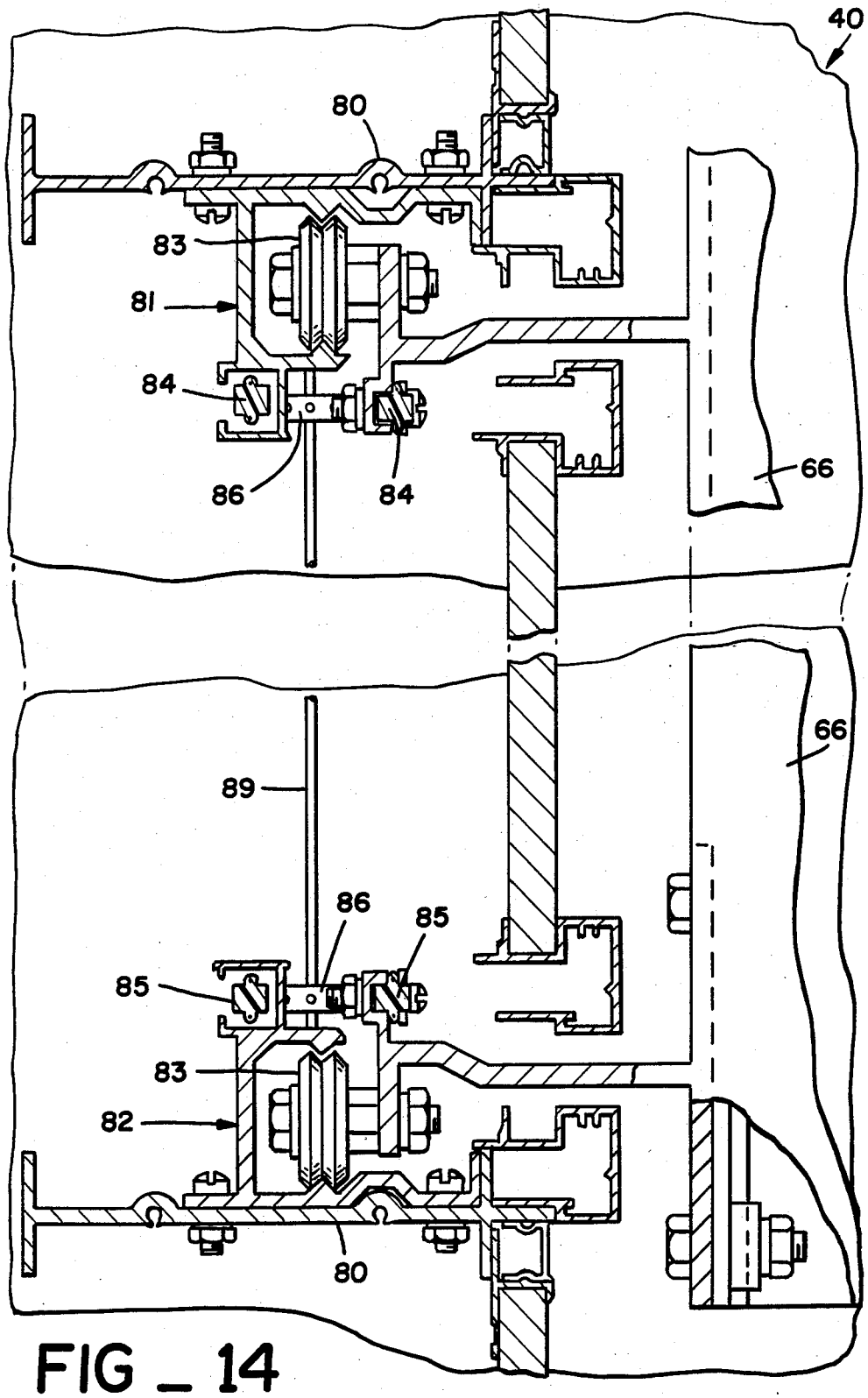
FIG. 14 is an enlarged fragmentary cross-sectional view of the support means of FIG. 13.

Referring to FIGS. 13 and 14, details of the support structure 40 for the robot arm structure 20 are shown. Thus the support structure 40 comprises a rigid generally rectangular frame 80 defining a substantially vertical plane. Upper 81 and lower 82 rigid track members are rigidly mounted within the frame 80. The carrier 66 of the robot arm structure 20 is mounted on the track members 81 and 82 by means of rollers 83. The carrier 66 of the robot arm structure 20 is attached to upper and lower pin driven endless belt means 84 and 85. The belt means 84 and 85 is driven by drive sprockets 86 mounted on a vertical shaft 87 at one end of the vertical frame 80. The belts 84 and 85 are circulated about idler sprockets 88 mounted on a similar vertical shaft 89 at the opposite end of the frame 80. A drive means 90 which may be an electrical motor, for example, is adapted to drive the shaft 87 and drive sprockets 86 through a further pin driven apertured endless belt 92 and sprocket 94. The drive means 90 may be a stepping motor, for example, thus enabling the carrier means 66 to be precisely indexed in its movements back and forth from one end of the frame 80 to the other.

Referring to FIG. 14 a fragmentary cross-sectional view of the support structure 40 of FIG. 13 is shown. The rigidity of the support structure 80 is readily apparent from FIG. 14 as is the stability of the roller support structure 83 for the carrier 66. The precision of the drive provided by the pin driven belt and stepping motor coupled with the rigidity of the frame and stability of the roller mounting structure will enable precise control over the positioning of the carrier 66.

Figure 15:
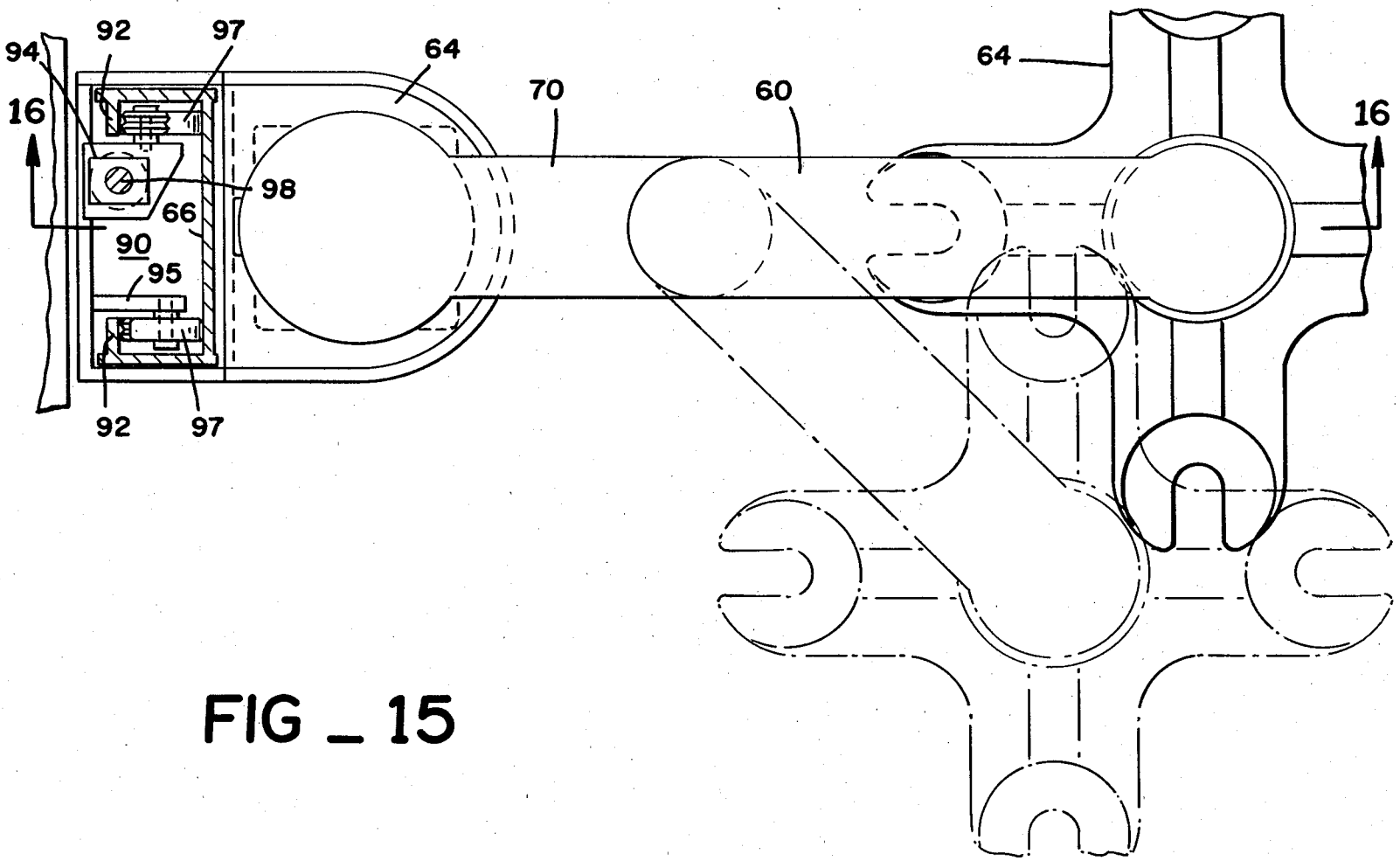
FIG. 15 is an enlarged top plan view partly in section showing the robotic arm structure of FIG. 10 with an alternate position of the arm structure indicated in phantom.

The mounting of the shoulder 64 of the robot arm structure 20 on the carrier 66 is shown in FIG. 15. The carrier 66 is an open-sided box beam as shown in cross-section at the left of FIG. 15. The shoulder 64 is provided with a rectangular opening 90 therethrough to receive the cross-section of the carrier 66 with a non-contacting fit. The open side of the beam structure of the carrier 66 is provided with flanges 92 having an interior ridge or track formed thereon. A lead screw follower 94 is rigidly mounted on the shoulder 64 and projects into the opening 90 between the flanges 92. In addition, a guide wheel support member 95 is mounted on the shoulder 64 and projects into the opening 90. Guide wheels 96 having a groove formed about the periphery thereof to receive the track on the flanges 92 are mounted on the lead screw follower in contact with such track on one of such flanges 92. Similarly, guide wheels having a groove formed about the periphery thereof are mounted on the guide wheel support member in contact with the track on the other flange 92. In addition, guide rollers 97 are mounted on the lead screw follower structure and on the guide wheel support member in contact with the wall of the carrier 66 opposite the open side thereof to complete the support of the shoulder 64 on the carrier 66 for smooth low friction movement thereon. The lead screw 98 is shown in cross-section in FIG. 15 and is mounted for rotation on the carrier 66.

Referring to FIG. 13, the lead screw 98 is rotated by a drive means 99 mounted on the carrier 66 which drive means may be an electrical stepping motor, for example, coupled to the lead screw 98 through an appropriate gear box. The lead screw 98 provides precise control of the movement of the shoulder 64 along the carrier 66 in a direction normal to the movement of the carrier 66 by the belts 84 and 85. Thus the shoulder 64 may be precisely positioned at any point within the frame 80 as desired.

Figure 16:
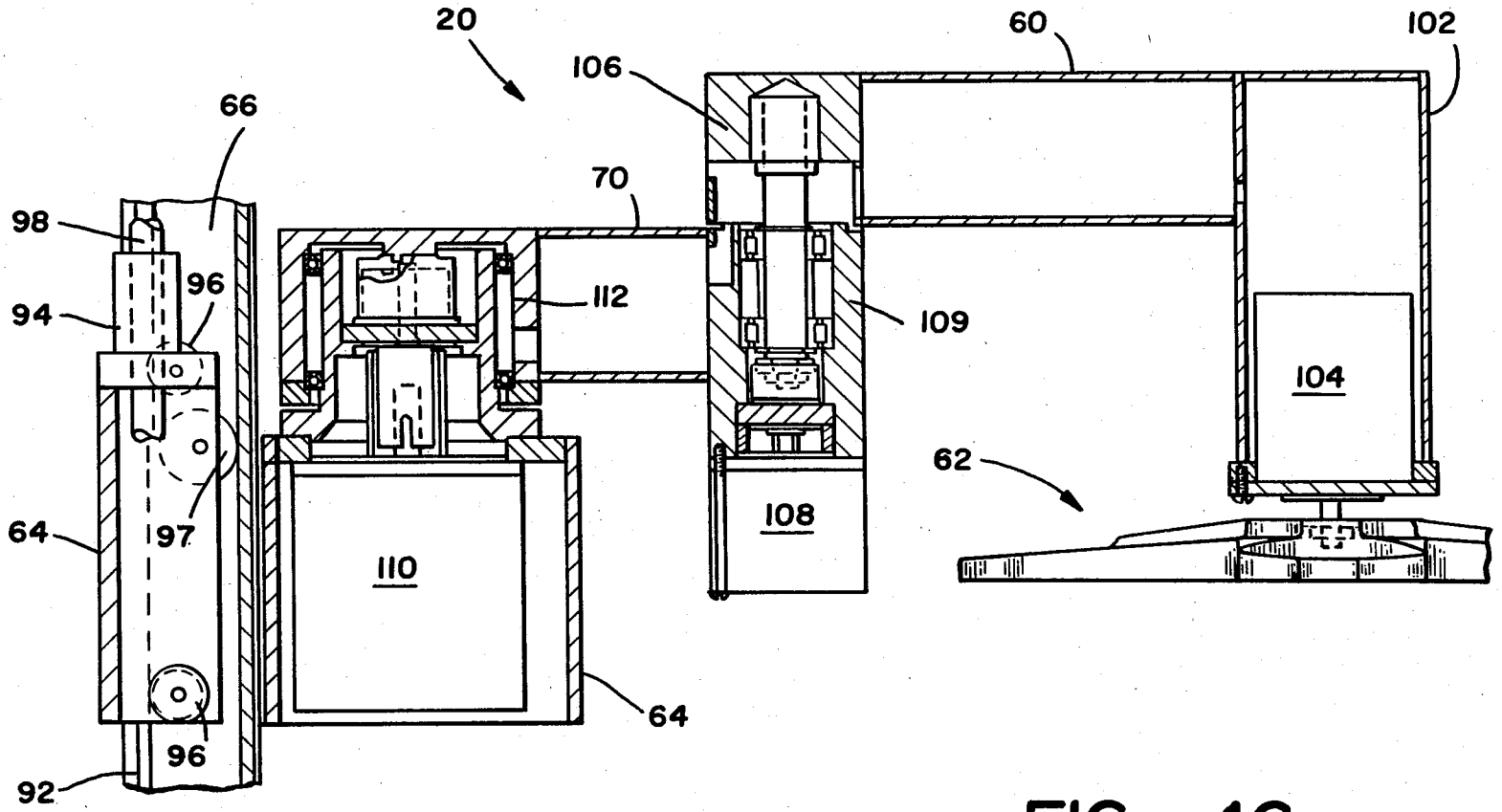
FIG. 16 is a cross-sectional view taken along line 16—16 of FIG. 15.

Referring to FIG. 16, the arm 60 of the robot arm structure 20 is preferably an elongated tubular body made of light weight metal such as aluminum, for example. A housing 102 is mounted at one end of the arm 60 and contains the drive means 104 for the receptacle receiving and support means 62. The housing 102 may also comprise a tubular member of light weight metal such as aluminum extending transversely of the arm 60 closed at the upper end and having the drive means 104 rigidly mounted and closing the other end thereof. The drive means 104 may comprise an electrical stepping motor having the receptacle receiving and support means 62 mounted on the shaft thereof for rotation.

The other end of the arm 60 terminates in a drive hub 106 mounted on the shaft of the drive means 108 which may be an electrical stepping motor, for example. The drive means 108, together with an appropriate bushing 109 is mounted at the end of the second arm 70 of the robot arm structure 20. The shaft of the drive means is journaled through the bushing 109 for rotation of the arm 60 with respect to the arm 70. The other end of the arm 70 is mounted on the shaft of a drive means 110 carried by the shoulder 64 of the robot arm structure. The drive means 110 may be a further electrical stepping motor, for example, and the arm 70 may be mounted on the shoulder means by an appropriate bushing or bearing 112 for rotation of the arm 70 by the shaft of the drive means 110. The bushing structure 112 and the bushing structure 109 must, of course, be capable of withstanding the bending moment imposed on the robot arm structure 20 by the weight of receptacles 25 filled with flowable material and carried by the receptacle receiving and support means 62 at the end of the arm 60.

It will be seen that the robot arm structure including arms 60 and 70, housing 102 and bushings 109 and 112 provide for the stable support of receptacles carried by the receptacle receiving and support means 62. The drive means 104, 108 and 110 provide for the precise rotation of the receptacle receiving and support means 62, arm 60 and arm 70 with respect to each other and with respect to the shoulder 64 which is in turn mounted on the carrier means 66 with great stability. Thus, receptacles filled with flowable materials may be easily and rapidly moved by the robot arm structure limited only by inertial forces acting on the flowable materials in the receptacles.

A model of the embodiment of the invention as shown in the drawing and described hereinabove has been constructed and successfully tested. In such model movement of the carrier 66 by the belts 84 and 85 with a resolution of 0.0020 inch and movement of the shoulder 64 on the carrier 66 by the lead screw 98 with a resolution of 0.0025 inch was provided. Similarly, rotation of the arm 70 on the shoulder through an angle of 180° with 0.0225° resolution, rotation of the arm 60 with respect to the arm 70 through an arc of 200° with a resolution of 0.300°, and full rotation of the receptacle receiving and support means 62 with a resolution of 0.1800° was provided.

The robot arm structure was constructed of heavy-duty aluminum with an extruded aluminum frame 80 including the tracks 81 and 82 and the carrier beam 66. Industrial quality stepping motors, gear reducers, bearings and guides were used.

Figure 17:
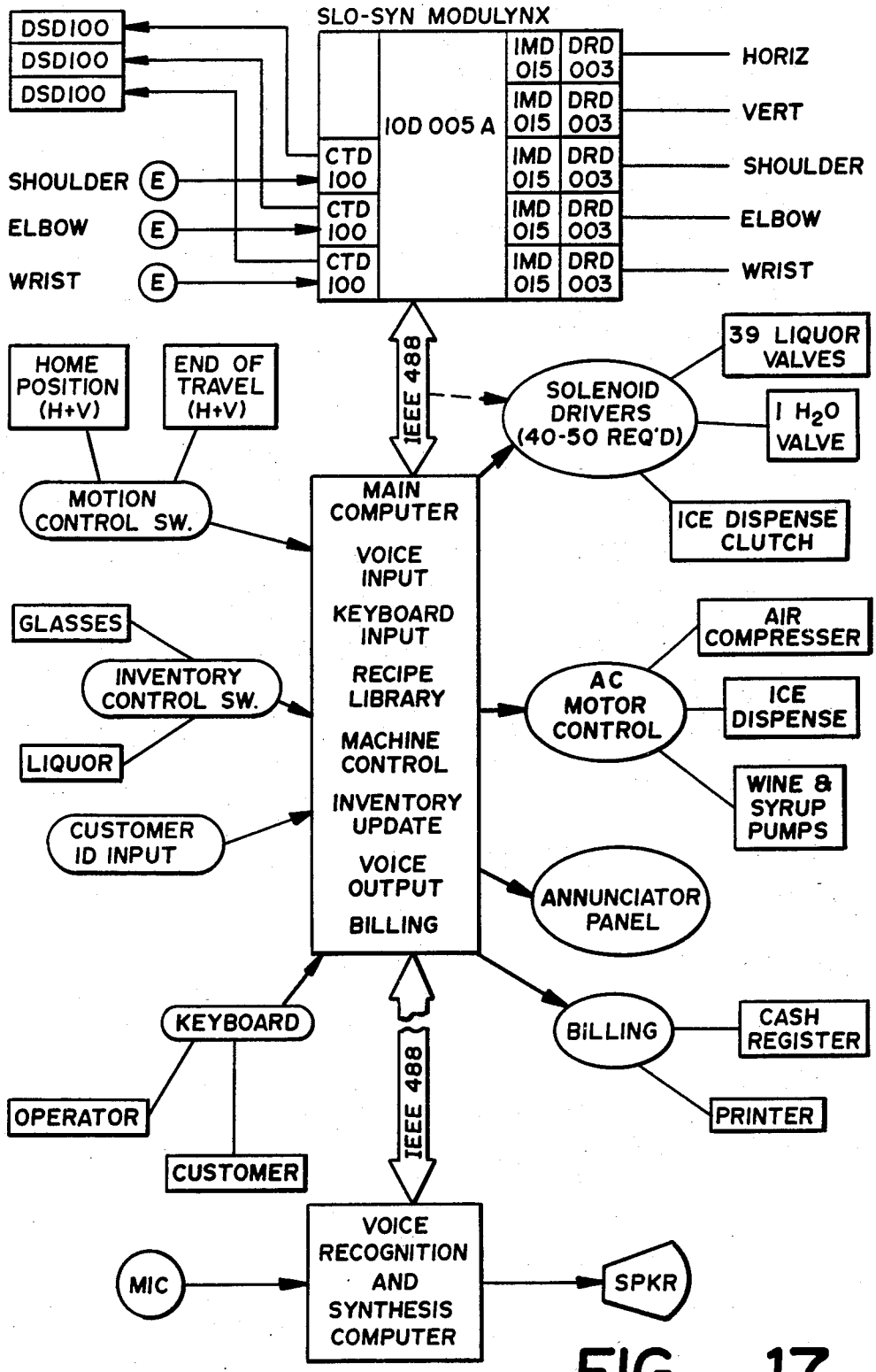
FIG. 17 is a block diagram of a control means suitable for use in this embodiment of the invention.

Referring to FIG. 17, a block diagram of the control system used in the model as actually built and successfully tested is shown. The main computer was a 6502 microprocessor with a 64K random access memory. Heavy-duty high current power supplies and high power motor drivers were utilized. Micro-stepping motor indexers with programmable five-axis indexer logic and an intelligent computer interface (RS-232-C) were also utilized.

The main computer included a single 5¼ inch floppy disc drive and a single side, double density disc with 140 kilobits capacity. An Apple-DOS operating system and Apple IIe compatible software were utilized.

Figure 18:
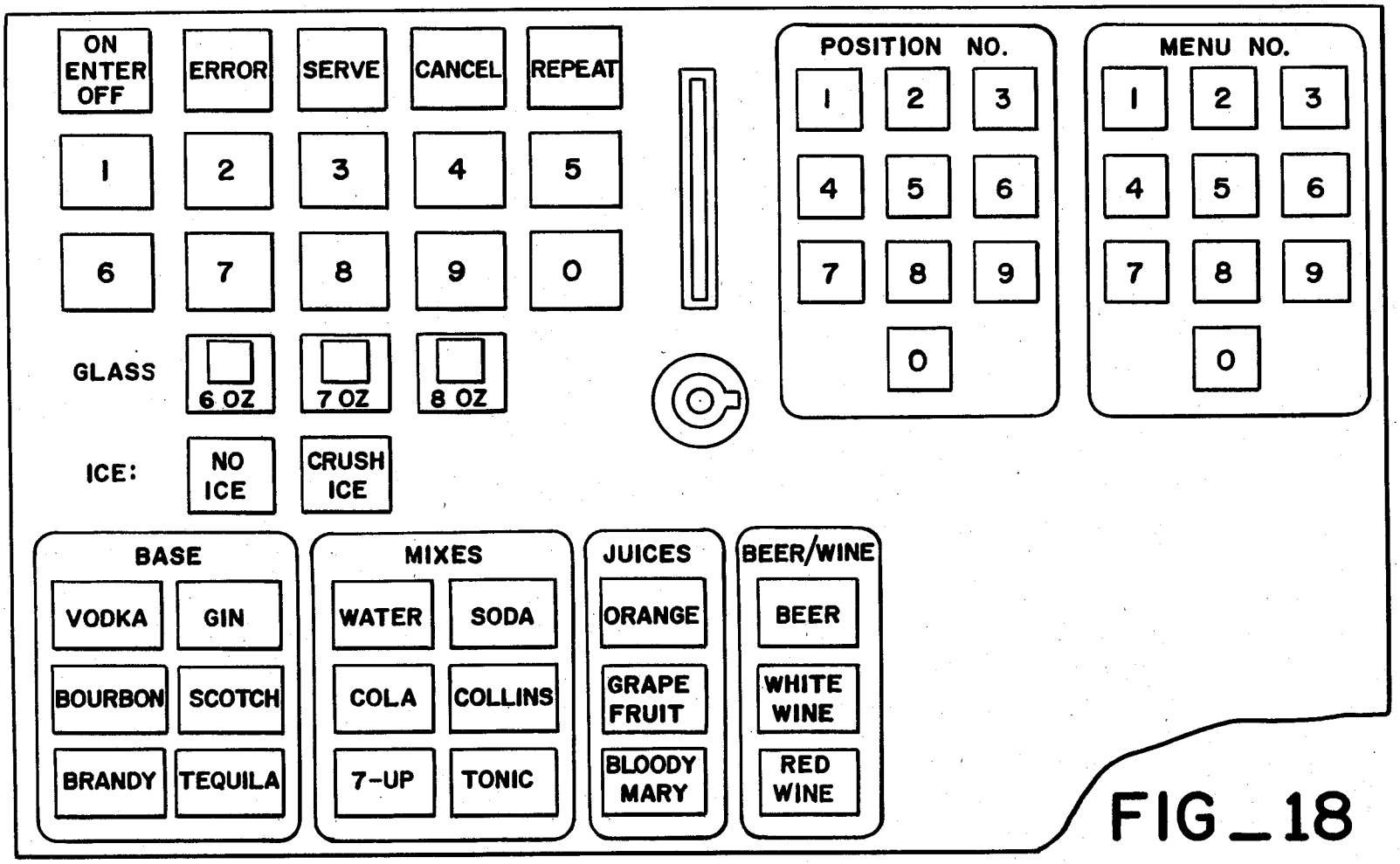
FIG. 18 is a top plan view of a control panel suitable for use as a part of the control means of FIG. 17.

Referring to FIG. 18, a 62 key ASCII typewriter style keyboard as actually used is shown. It will be seen that the keyboard provides for the selection of receptacle size and delivery position in addition to desired mixes and their quantity. The keyboard controls a 64-line digital relay valve control and an ice dispenser control interface through the computer. The keyboard was interfaced with a Mitsubishi Credit Card verification device and NCR hardware for automatic billing. All of the controls including the voice recognition and voice synthesis computer are commmercially available.

It is believed that those skilled in the art will make obvious modifications in the embodiment of this invention as disclosed in the drawing and described hereinabove without departing from the scope of the following claims. Pneumatic and hydraulic drive means could be substituted for the electrical drive means disclosed hereinabove. The number of dispensing points, or the number of delivery points, or both, may be greatly increased over that disclosed hereinabove. A variety of commercially available metering devices for flowable materials can be used. Coin operation controls, as well as the customer I.D. input devices and automatic billing devices tested, are commercially available and suitable for use in combination with applicant's invention.

What is claimed is:

1. Apparatus for the automated assembly of flowable materials into a receptacle and delivery to a selected location comprising:

(a) an elongated substantially rectilinear arm of given length having a given axis of elongation;

(b) receptacle receiving and support means mounted on one end of said arm for rotation about a first axis extending transversely of said axis of elongation of said arm;

(c) shoulder means having the other end of said elongated arm mounted thereon for rotation about a second axis extending substantially parallel to said first axis transversely of said axis of elongation of said arm;

(d) carrier means mounting said shoulder means for selective rectilinear movement in a given plane substantially parallel to said first and second axes;

(e) support means mounting said carrier means for selective rectilinear movement in a given plane normal to said selective rectilinear movement of said shoulder means;

(f) first drive means for selectively rotating said receptacle receiving and support means about said first axis;

(g) second drive means for selectively rotating said elongated arm about said second axis;

(h) third drive means providing limited selective rectilinear movement of said shoulder means on said carrier means in said given plane;

(i) fourth drive means providing limited selective rectilinear movement of said carrier means on said support means in said given plane;

(j) storage structure for flowable materials positioned adjacent the limits of said selective rectilinear movements of said shoulder means and said carrier means established by said third and fourth drive means;

(k) a plurality of flowable material dispensing means positioned adjacent said given plane in spaced non-interfering relationship to said selective rectilinear movements of said shoulder means and said carrier means, said spacing of said dispensing means from said given plane being less than said given length of said elongated substantially rectilinear arm;

(l) means for conducting flowable materials from said storage structure to said dispensing means; and (m) computer means providing integrated control of said first, second, third and fourth drive means in response to a given command.

2. Apparatus as claimed in claim 1 wherein said support means comprises a generally rectilinear frame having rail means along one side thereof mounting said carrier means for movement along said rail means.

3. Apparatus as claimed in claim 2 wherein said fourth drive means comprises a drive sprocket mounted for rotation about an axis normal to said rail means at one end thereof, an idler sprocket mounted for rotation about an axis normal to said rail means at the other end thereof, an endles apertured belt mounted for circulation about said drive sprocket and said idler sprocket, means attaching said carrier means to a given location on said endless belt and a motor for selectively driving said drive sprocket.

4. Apparatus as claimed in claim 3 wherein said carrier means comprises an elongated rectilinear beam member extending normally to said rail means; and wherein said third drive means comprises an elongated lead screw extending along said beam member carrying said shoulder means thereon through a lead screw follower and a motor for selectively rotating said lead screw.

5. Apparatus as claimed in claim 4 wherein said first drive means comprises a first electrical stepping motor mounted on said one end of said arm with the shaft thereof oriented for rotation about said first axis and with said receptacle receiving and support means mounted on said shaft thereof and wherein said second drive means comprises a second electrical stepping motor mounted on said shoulder with the shaft thereof oriented for rotation about said second axis and with said other end of said arm mounted on said shaft thereof.

6. Apparatus as claimed in claim 1 including a plurality of receptacle storage locations positioned adjacent said given plane in spaced non-interfering relationship to said selective rectilinear movements of said shoulder means and said carrier means, said spacing of said receptacle storage locations from said given plane being less than said given length of said elongated substantially rectilinear arm.

7. Apparatus as claimed in claim 6 including a plurality of receptacle delivery locations positioned adjacent said given plane in spaced non-interfering relationship to said selective rectilinear movements of said shoulder means and said carrier means, said spacing of said receptacle delivery locations from said given plane being less than said given length of said elongated substantially rectilinear arm.

8. Apparatus as claimed in claim 6 wherein each said receptacle storage location comprises a vertically inclined shelf with a stop means at the lowermost extremity thereof, said shelf being dimensioned to support a plurality of receptacles for movement by gravity into engagement with said stop means and removal in turn, the supporting surface of said shelf having a sheet of apertured self-lubricating plastic material thereon.

9. Apparatus as claimed in claim 1 including a plurality of flowable material dispensing means within said storage structure positioned adjacent the limits of said selective rectilinear movements of said shoulder means and said carrier means, each said flowable material dispensing means being positioned at a distance less than said given length of said elongated substantially rectilinear arm from said limits of said selective rectilinear movements of said shoulder means and said carrier means established by said third and fourth drive means.

10. Apparatus as claimed in claim 9 wherein said flowable materials are stored in said storage structure at a vertical height greater than the vertical height of said flowable material dispensing means and said means for conducting flowable materials from said storage structure to said dispensing means comprises a tubular conduit having an electrically operated valve means interposed therein and controlled by said computer means.

11. Apparatus as claimed in claim 9 wherein said flowable materials are stored in said storage structure at a vertical height less than the vertical height of said flowable material dispensing means and said means for conducting flowable materials from said storage structure to said dispensing means comprises a tubular conduit having an electrically driven pump means interposed therein and controlled by said computer means.

12. Apparatus as claimed in claim 9 wherein said flowable materials are stored in said storage structure under pressure greater than atmospheric pressure and said means for conducting flowable materials from said storage structure to said dispensing means comprises a tubular conduit having an electrically operated valve means interposed therein and controlled by said computer means.

13. Apparatus as claimed in claim 1 wherein said receptacle receiving and support means comprises a bifurcated member adapted to receive therein a reduced cross-sectional dimension of said receptacle.

14. Apparatus as claimed in claim 1 wherein said elongated substantially rectilinear arm of given length is divided into two sections intermediate the ends thereof with said sections interconnected for rotation about a third axis parallel to said first and second axes and wherein a fifth drive means is provided for selectively rotating said two sections with respect to each other under the integrated control of said computer means.

15. Appararus ror the automated assembly of flowable materials into a receptacle and delivery to a selected location comprising:

(a) a generally rectangular rigid frame of given horizontal length, vertical height and horizontal width;

(b) rail means mounted on and extending along the bottom of said frame;

(c) carrier means mounted on said rail means for movement along the horizontal length of said frame;

(d) shoulder means mounted on said carrier means for movement along the vertical height of said frame;

(e) a first elongated substantially rectilinear arm of given length having one end mounted on said shoulder means for rotation about a first substantially vertical axis;

(f) a second elongated substantially rectilinear arm of given length having one end mounted on the other end of said first elongated substantially rectilinear arm for rotation about a second substantially vertical axis;

(g) a receptacle receiving and support means mounted on the other end of said second elongated substantially rectilinear arm for rotation about a third substantially vertical axis, said receptacle receiving and support means comprising a body having an open ended slot formed therein extending normally of said third substantially vertical axis, said slot being dimensioned to receive therein a reduced transverse dimension of said receptacle, (h) first drive means for moving said carrier means on said rail means, second drive means for moving said shoulder means on said carrier means, third drive means for rotating said first arm on said shoulder means, fourth drive means for rotating said second arm on said first arm, fifth drive means for rotating said receptacle receiving and support means on said second arm;

(i) computer means programmed for the simultaneous integrated control of said first, second, third, fourth and fifth drive means in response to a given command signal;

(j) flowable material dispensing means mounted with said frame in spaced relation thereto, the spacing of said flowable material dispensing means from said frame being less than the total of said given length of said first arm and said given length of said second arm;

(k) receptacle storage means mounted with said frame in spaced relation thereto, the spacing of said receptacle storage means from said frame being less than the total of said given length of said first arm and said given length of said second arm; and (l) receptacle delivery means mounted with said frame in spaced relation thereto, the spacing of said receptacle delivery means from said frame being less than the total of said given length of said first arm and said given length of said second arm.

16. Apparatus as claimed in claim 15 wherein flowable material storage structure is provided above said frame along said horizontal length thereof.

17. Apparatus as claimed in claim 16 wherein said flowable material dispensing means, said receptacle storage means and said receptacle delivery means are positioned below said vertical height of said frame and outside said horizontal length and horizontal width of said frame.

* * * * *